US011294319B2

(12) United States Patent
Takahashi

(10) Patent No.: US 11,294,319 B2
(45) Date of Patent: Apr. 5, 2022

(54) IMAGE FORMING APPARATUS INCLUDING SHEET PASSING DETECTION

(71) Applicant: KYOCERA Document Solutions Inc., Osaka (JP)

(72) Inventor: Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/140,347

(22) Filed: Jan. 4, 2021

(65) Prior Publication Data

US 2021/0208530 A1 Jul. 8, 2021

(30) Foreign Application Priority Data

Jan. 8, 2020 (JP) ..... JP2020-001693

(51) Int. Cl.
*G03G 15/00* (2006.01)
*G03G 15/20* (2006.01)

(52) U.S. Cl.
CPC ..... *G03G 15/70* (2013.01); *G03G 15/2053* (2013.01); *G03G 15/2064* (2013.01); *G03G 15/6558* (2013.01); *G03G 15/6573* (2013.01); *G03G 15/657* (2013.01)

(58) Field of Classification Search
CPC ... G03G 15/70; G03G 15/6558; G03G 15/657
USPC ..... 322/21
See application file for complete search history.

(56) References Cited

U.S. PATENT DOCUMENTS 7,437,110 B2 10/2008 Kondo et al.
9,116,496 B2 * 8/2015 Miyamoto ..... G03G 15/70
2001/0048822 A1 * 12/2001 Hanyu ..... G03G 15/2039 399/67

FOREIGN PATENT DOCUMENTS

JP 2007-233011 A 9/2007

* cited by examiner

*Primary Examiner* — Arlene Heredia
(74) *Attorney, Agent, or Firm* — Studebaker & Brackett PC

(57) ABSTRACT

An image forming device includes a sheet feeding device, an image forming part, a fixing device, a conveyance path, a first sensor and a second sensor. The first sensor is disposed on the conveyance path on a downstream side of the fixing device in the conveyance direction and detects the sheet passed along the conveyance path. The second sensor is disposed on the conveyance path on an upstream side of the fixing device in a conveyance direction and detects the sheet passed along the conveyance path. The fixing device stops a driving of a heating source and stops a rotation of a fixing belt when the first sensor does not detect the sheet passing properly. The fixing device stops the driving of the heating source and stops the rotation of the fixing belt after a predetermined period when the second sensor do not detect the sheet passing properly.

6 Claims, 5 Drawing Sheets

IMAGE FORMING APPARATUS INCLUDING SHEET PASSING DETECTION

INCORPORATION BY REFERENCE

This application is based on and claims the benefit of priority from Japanese patent application No. 2020-001693 filed on Jan. 8, 2020, which is incorporated by reference in its entirety.

BACKGROUND

The present disclosure relates to an image forming apparatus including a fixing device which fixes a toner image on a sheet.

In a fixing device using a fixing belt, a heating source such as a halogen heater is sometimes provided in a hollow space of the fixing belt. The fixing belt is pressed on a pressing roller by a pushing member from its inner circumferential face side, and a pressing area is formed between the fixing belt and the pressing roller. When the pressing roller is driven to be rotated and then the fixing belt is driven by the pressing roller to be rotated, a sheet on which a toner image is transferred passes through the pressing area. As the sheet passes through the pressing area, the toner image is heated and pressed to be fixed on the sheet.

The fixing belt is slid with respect to the pushing member when it is driven by the pressing roller to be rotated. Generally, in order to reduce friction between the pushing member and the fixing belt, lubricant (oil or grease) is applied between the fixing belt and the pushing member. This makes it possible to rotate the fixing belt smoothly.

In an image forming apparatus provided with the above described fixing device, in a case where a sheet jamming occurs during an image forming operation, the image forming apparatus conventionally stops the image forming operation containing a fixing operation.

When the fixing operation is stopped due to the sheet jamming, in the above described fixing device, the pressing roller is stopped and the rotation of the fixing belt is stopped. Then, due to heat accumulated in the halogen heater, the fixing belt may be partially overheated. When the overheating occurs frequently, the lubricant applied between the fixing belt and the pushing member may be exhausted, and then the fixing belt may not be driven by the pressing roller to be rotated smoothly. As a result, the sheet jamming may occur in the fixing device.

SUMMARY

In accordance with an aspect of the present disclosure, an image forming device includes a sheet feeding device, an image forming part, a fixing device, a conveyance path, a first sensor and a second sensor. The sheet feeding device feeds a sheet in a predetermined conveyance direction. The image forming part is disposed on a downstream side of the sheet feeding device in the conveyance direction and forms a toner image on the sheet fed by the sheet feeding device. The fixing device is disposed on a downstream side of the image forming part in the conveyance direction, and includes a fixing member heated by a heating source and a pressing member coming into contact with the fixing member to form a pressing area between the fixing member and the pressing member. The fixing member and the pressing member are rotated to fix the image on the sheet as the sheet is passed through the pressing area after passing through the image forming part. Along the conveyance path, the sheet is conveyed from the sheet feeding device to the fixing device through the image forming part. The first sensor is disposed on the conveyance path on a downstream side of the fixing device in the conveyance direction and detects the sheet passed along the conveyance path. The second sensor is disposed on the conveyance path on an upstream side of the fixing device in the conveyance direction and detects the sheet passed along the conveyance path. The fixing device stops a driving of the heating source and stops a rotation of the fixing belt when the first sensor does not detect the sheet passing properly. The fixing device stops the driving of the heating source and stops the rotation of the fixing belt after a predetermined period when the second sensor do not detect the sheet passing properly.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference the attached drawings, an image forming apparatus according to one embodiment of the present invention will be described.

Figure 1:
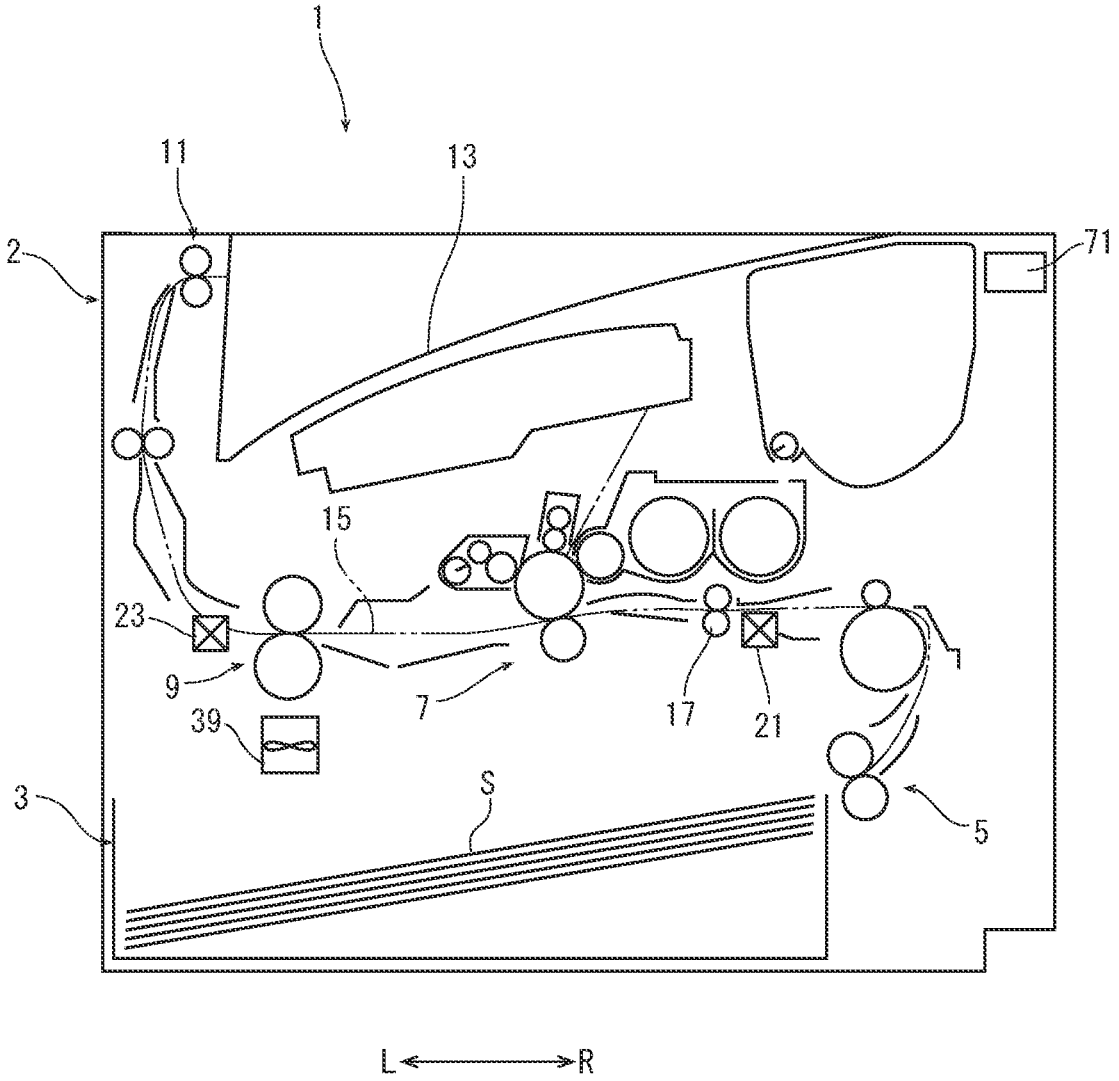
FIG. 1 is a front view schematically showing an inner structure of an image forming apparatus according to one embodiment of the present disclosure.

Firstly, with reference to FIG. 1, the image forming apparatus 1 will be described. FIG. 1 is a front view schematically showing an inner structure of the image forming apparatus 1. In the following description, a near side of a paper surface on which FIG. 1 is drawn is defined as a front side of the image forming apparatus 1. "Fr", "Rr", "L" and "R" marked in each figure respectively show "front", "rear", "left" and "right" of the image forming apparatus 1.

An apparatus main body 2 of the image forming apparatus 1 is provided with a sheet feeding cassette 3 in which a sheet S is stored, a sheet feeding device 5 which feeds the sheet S from the sheet feeding cassette 3, an image forming part 7 which forms a toner image on the sheet S, a fixing device 9 which fixes the toner image on the sheet 7, a discharge device 11 which discharges the sheet S, and a discharge tray 13 on which the discharged sheet S is stacked. In the apparatus main body 2, a conveyance path 15 for the sheet S is formed along a conveyance direction Y from the sheet feeding device 5 to the discharge device 11 through the image forming part 7 and the fixing device 9 in order. On the conveyance path 15, a resist rollers pair 17 is provided on an upstream side of the image forming part 7 in the conveyance direction Y.

On the conveyance path 15, a sheet feeding sensor 21 is provided as a second sensor on an upstream side of the resist rollers pair 17, and a fixing sensor 23 is provided as a first sensor on a downstream side of the fixing device 9.

Figure 2:
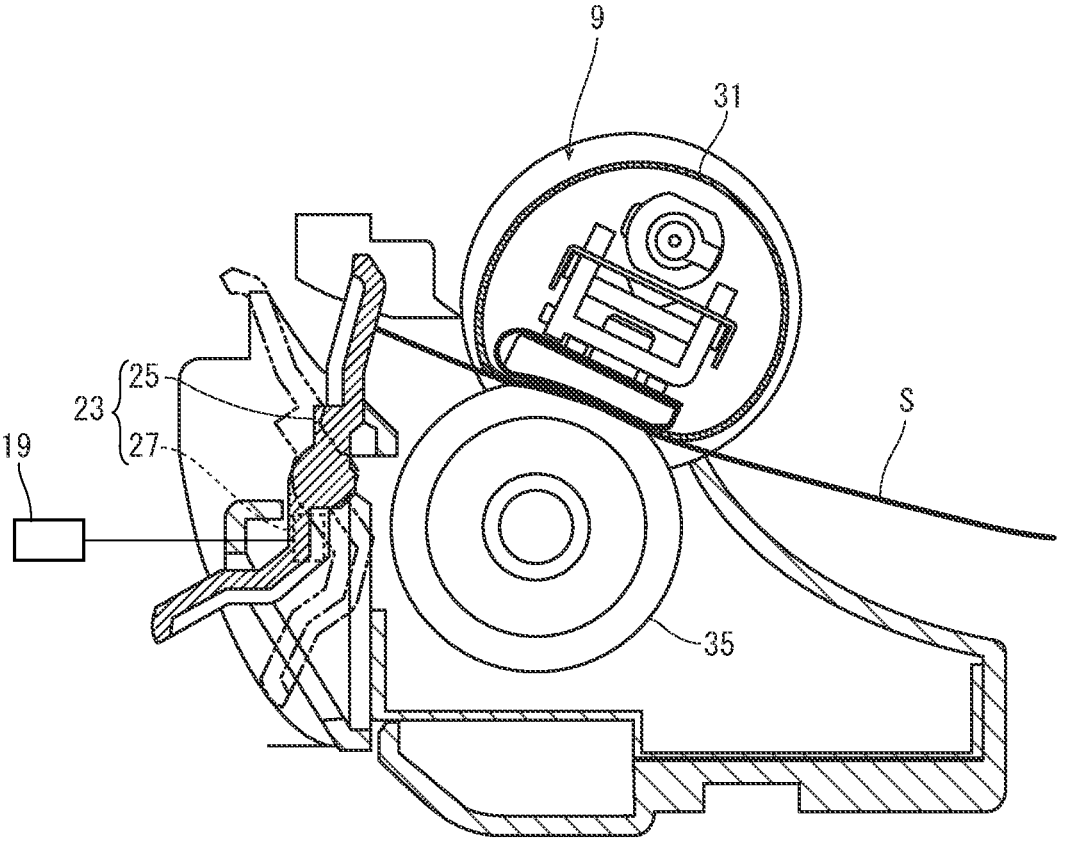
FIG. 2 is a front view showing a fixing device and a fixing sensor, in the image forming apparatus according to the embodiment of the present disclosure.

With reference to FIG. 2, an example of the fixing sensor 23 will be described. FIG. 2 is a front view showing the fixing device 9 and the fixing sensor 23. The sheet feeding sensor 21 has the same configuration as the fixing sensor 23.

The fixing sensor 23 includes an actuator 25 and a photo interrupter 27. The actuator 25 is configured to turn when the sheet S comes into contact with. The photo interrupter 27 forms or blocks an optical path by turning the actuator 25. The photo interrupter 27 is electrically connected to a controller 19, sends an ON signal to the controller 19 when the optical path is formed and sends an OFF signal to the controller 19 when the optical path is blocked.

Figure 3:
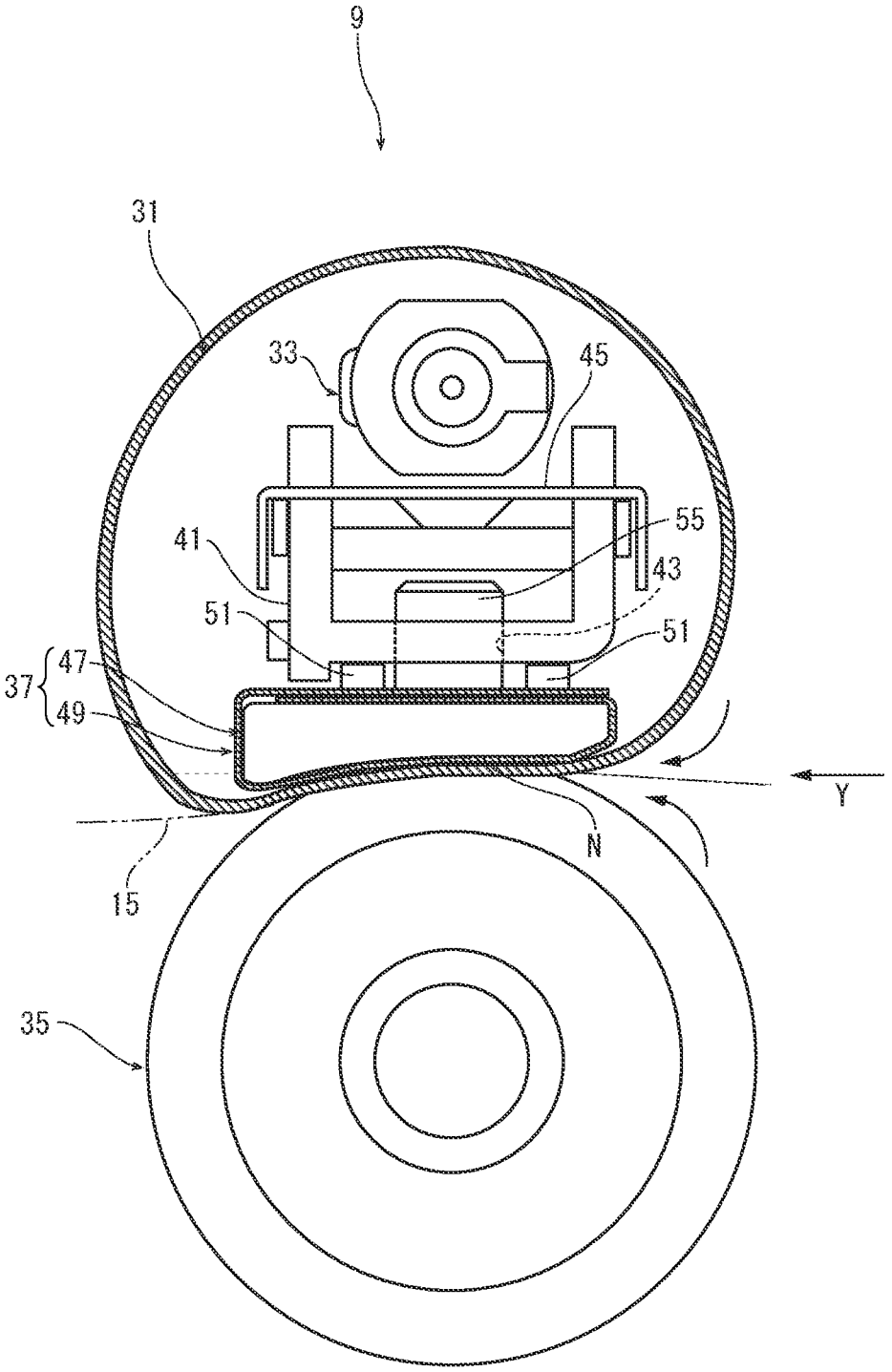
FIG. 3 is a sectional view showing the fixing device, in the image forming apparatus according to one embodiment of the present disclosure.
Figure 4:
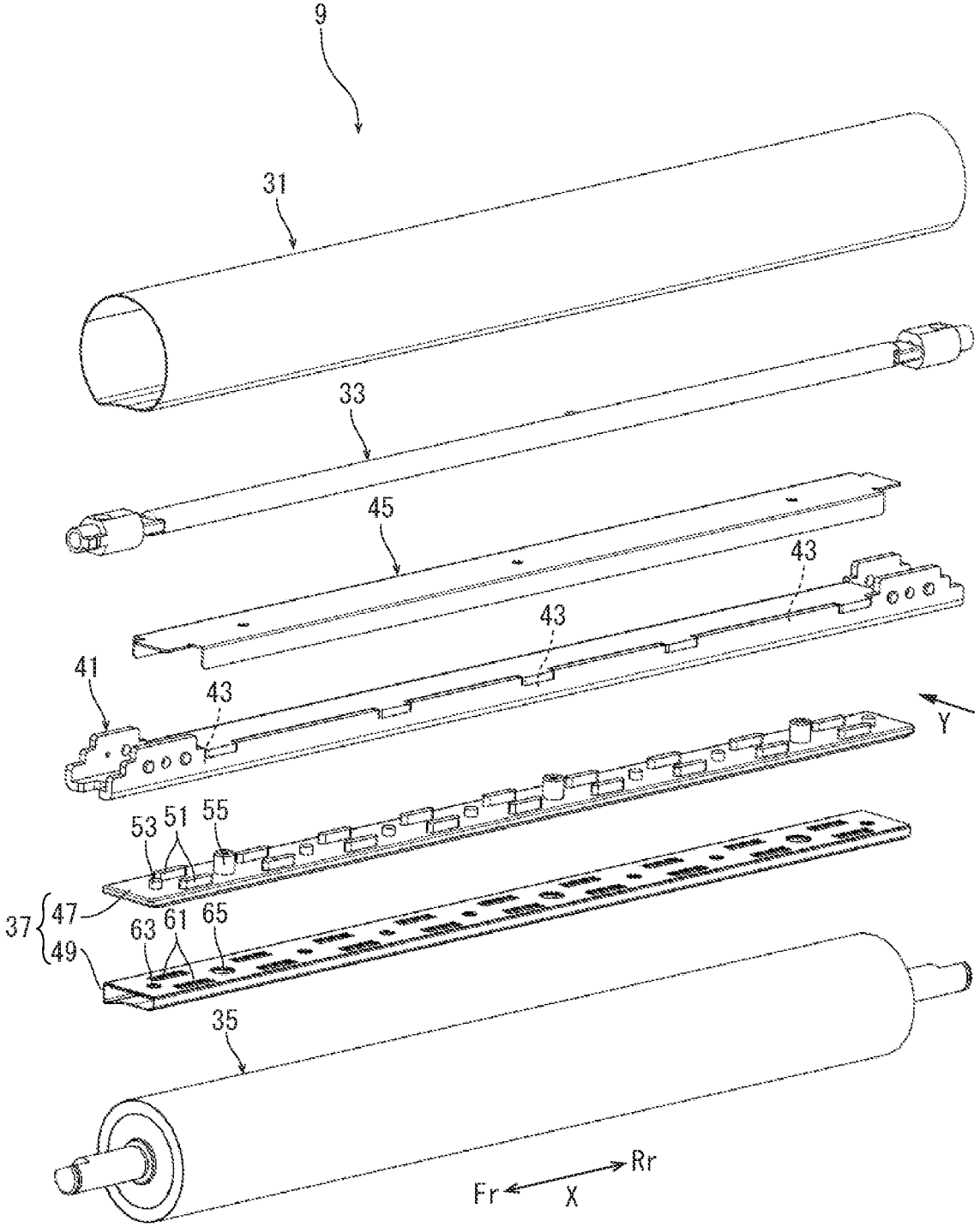
FIG. 4 is a disassembled perspective view showing the fixing device, in the image forming apparatus according to one embodiment of the present disclosure.

Next, with reference to FIG. 3 and FIG. 4, the fixing device 9 will be described. FIG. 3 is a sectional view showing the fixing device 9 and FIG. 4 is a disassembled perspective view showing the fixing device 9.

The fixing device 9 includes a fixing belt 31 as a fixing member, a halogen heater 33 as a heating source which heats the fixing belt 31, a pressing roller 35 as a pressing member which forms a pressing area N between the fixing belt 31 and the pressing roller 35, a pushing member 37 which pushes the fixing belt 31 on the pressing roller 35 at the pressing area N, and a fan 39 (refer to FIG. 1).

The fixing belt 31 is an endless belt having a predetermined inner diameter and a width longer than a width of the sheet S. The fixing belt 31 is made of flexible material, and has a base layer, an elastic layer formed around the outer circumferential face of the base layer, and a release layer formed around the outer circumferential face of the elastic layer. The base layer is made of metal, such as SUS and Ni, for example. The elastic layer is made of silicon rubber, for example. The release layer is made of PFA tube, for example. Both ends of the fixing belt 31 are supported by a fixing housing (not shown) in a rotatable manner.

Into the lower hollow space of the fixing belt 31, a stay 41 penetrates. The stay 41 is a channel-shaped member having a length longer than a length of the fixing belt 31 in the width direction X and whose upper face is opened. Both ends of the stay 41 are supported by the fixing housing. In the bottom plate of the stay 41, three positioning holes 43 are formed at predetermined intervals in the width direction X. On the upper face of the stay 41, a reflection plate 45 is supported.

The halogen heater 33 has almost the same length as a length of the fixing belt 31 in the width direction X. The halogen heater 33 is disposed in the upper hollow space of the fixing belt 31 (above the stay 41), and both ends of the halogen heater 33 are supported by the fixing housing. The halogen heater 33 radiates radiant heat on the inner circumferential face of the fixing belt 31 (the narrower portion than the upper half portion of the inner circumferential face of the fixing belt 31) to heat the fixing belt 31. The radiant heat radiated downward from the halogen heater 33 is reflected by the reflection plate 45 and radiated on the inner circumferential face of the fixing belt 31. The halogen heater 33 is electrically connected to the controller 19.

The pressing roller 35 has a core metal, an elastic layer formed around the outer circumferential face of the core metal, a release layer formed around the outer circumferential face of the elastic layer. The elastic layer is made of silicon rubber, for example. The release layer is made of PFA tube, for example.

The pressing roller 35 is disposed below the fixing belt 31, and is supported by the fixing housing. The pressing roller 35 comes into contact with the outer circumferential face of the fixing belt 31, and the pressing area N is formed between the pressing roller 35 and the fixing belt 31. The pressing roller 35 is connected to a motor (not shown), and is driven by the motor to be rotated. The motor is electrically connected to the controller 19. When the pressing roller 35 is rotated in the counterclockwise direction in FIG. 3, the fixing belt 31 is driven by the pressing roller 35 to be rotated in the clockwise direction opposite to the rotational direction of the pressing roller 35. As a result, the sheet S is passed through the pressing area N along the conveyance direction Y.

The pushing member 37 has a base plate 47 and a sliding sheet 49 wound around the base plate 47 and fixed to the base plate 47.

The base plate 47 is a flat parallelepiped member long in the width direction X of the fixing belt 31, and made of resin such as liquid crystal polymer, for example. On the upper face of the base plate 47, a plurality of (eighteen, for example) projections 51, a plurality of (seven, for example) fixing pins 53 and a plurality of (three, for example) positioning pins 55 are protruded in predetermined positions. The lower face of the base plate 47 is formed into a recessed shape.

The sliding sheet 49 is a rectangular sheet member having the same width as the base plate 47 and a length capable of being wound around the base plate 47 by one round, and is made by weaving PTFE fiver and PPS fiver together, for example. The sliding sheet 49 is wound around the base plate 47 by one round, and both end portions of the sliding sheet 49 are overlapped on the upper face of the base plate 47. Both end portions are formed with through holes 61 into which the projections 51 of the base plate 47 are fitted, fixing holes 63 into which the fixing pins 53 of the base plate 47 are fitted, and positioning holes 65 into which the positioning pins 55 of the base plate 47 are fitted.

The pushing member 37 is positioned with respect to the stay 41 with the positioning pins 55 of the base plate 47 fitted into the positioning holes 43 of the stay 41. The pushing member 37 (the sliding sheet 49) comes into contact with the inner circumferential face of the fixing belt 31 at the pressing area N with lubricant (oil, grease).

The fan 39 is disposed on a near side of the fixing belt 31 and the pressing roller 35 (for convenience of explanation, the fan 39 is drawn below the pressing roller 35 in FIG. 1). The fan 39 sucks outside air and blows it toward the fixing belt 31 and the pressing roller 35. The fan 39 is electrically connected to the controller 19.

Figure 5:
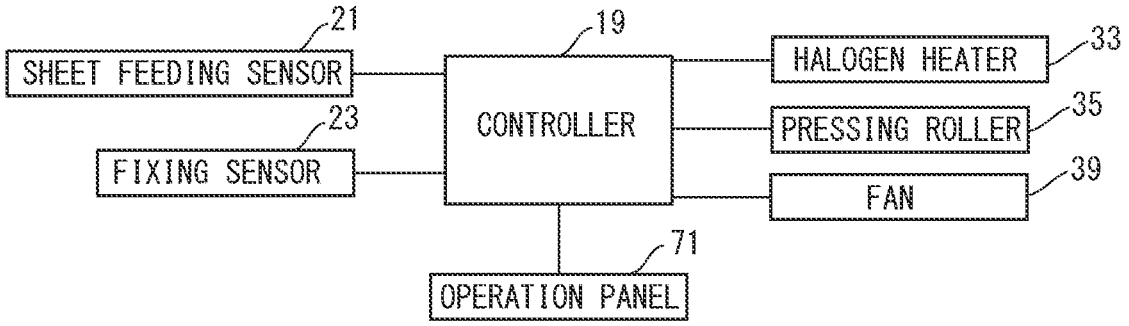
FIG. 5 is a block diagram showing a controller, in the image forming apparatus according to the embodiment of the present disclosure.

Next, with reference to a block diagram in FIG. 5, the controller 19 will be described. The controller 19 receives the ON signals and the OFF signals output from the photo interrupters 27 of the sheet feeding sensor 21 and the fixing sensor 23.

The controller 19 determines a sheet jamming based on the signal received from the photo interrupter 27. For example, when the sheet S comes into contact with the actuator 25 and the actuator 25 is turned in one direction to form the optical path (refer to the two-dotted chain line in FIG. 2), the photo interrupter 27 sends the ON signal to the controller 19. When the sheet S is conveyed properly, separated from the actuator 25 and the actuator 25 is turned in the other direction to block the optical path, the photo interrupter 27 sends the OFF signal to the controller 19. When the reception period of the ON signal is a certain period, the controller 19 determines that the sheet S is conveyed properly. On the other hand, when the reception period of the ON signal is longer than the certain period (when it is not switched from the ON signal to the OFF signal after the certain period), the controller 19 determines that the sheet S is not separated from the actuator 25 and the actuator 25 is kept with the optical path formed, that is, that the sheet S is not conveyed properly and a sheet jamming occurs. Furthermore, when the ON signal is not received from the fixing sensor 23 although the OFF signal is received from the sheet feeding sensor 21 after the certain period from the reception of the ON signal from the sheet feeding sensor 21, the controller 19 determines that the sheet S is not conveyed properly through the fixing device 9 and a sheet jamming occurs.

The controller 19 drives the halogen heater 33 and stops the driving of the halogen heater 33. Furthermore, the controller 19 drives the motor of the pressing roller 35 to rotate the pressing roller 35 in the predetermined direction. Furthermore, the controller 19 drives the fan 39 and stops the driving of the fan 39. Furthermore, the controller 19 receives a number of sheets S printed in one image forming operation (one fixing operation). The number of printed sheets S shows a number of printed sheets per one JOB, which is started when a start button is pushed or an image forming instruction is input, and for example, is calculated based on a number of times of switching operation between the ON signal and the OFF signal of the sheet feeding sensor 21.

The controller 19 is also electrically connected to an operation panel 71 as an informing part. The operation panel 71 is provided with a liquid crystal display and an operation button by which various instructions regarding the image forming operation are input.

The fixing operation of the fixing device 9 having the above configuration will be described. Firstly, the controller 19 drives the motor to rotate the pressing roller 35. The fixing belt 31 is pressed on the pressing roller 35 by the pushing member 37, and is driven by the pressing roller 35 to be rotated in an opposite direction to the rotational direction of the pressing roller 35. At this time, the sliding sheet 49 is slid with respect to the inner circumferential face of the fixing belt 31 via the lubricant. Furthermore, the controller 19 drives the halogen heater 33, and the halogen heater 33 heats the fixing belt 31. The fixing belt 31 is heated up to a fixable temperature (for example, 160 degrees) at which the toner image can be fixed on the sheet S. After the fixing belt 31 is thus heated, the sheet S on which the toner image is transferred is conveyed to the pressing area N. The sheet S is held between the fixing belt 31 and the pressing roller 35 and then passed through the pressing area N. At this time, the toner image is heated by the fixing belt 31 and also pressed by the pressing roller 35 and the fixing belt 31, and then fixed on the sheet S. The sheet S on which the toner image is fixed is conveyed along the conveyance path 15.

Next, a case where a sheet jamming is detected by the sheet feeding sensor 21 will be described. When the controller 19 does not receive the ON signal from the sheet feeding sensor 21 after a certain period since the sheet feeding device 5 starts the sheet feeding operation, the controller 19 determines that the sheet S is not conveyed from the sheet feeding cassette 3 properly and a no-sheet feeding occurs. Additionally, when the controller 19 does not receive the OFF signal from the sheet feeding sensor 21 after a certain period since the resist rollers pair 17 starts to be rotated at a certain timing after the reception of the ON signal from the sheet feeding sensor 21, the controller 19 determines that the sheet S is not conveyed from the sheet feeding cassette 3 properly and a sheet jamming occurs. When a sheet conveyance failure such as the sheet jamming is detected by the sheet feeding sensor 21 as described above, the controller 19 stops the driving of the halogen heater 33. Furthermore, after a predetermined period from the detection of the sheet conveyance failure, the controller 19 stops the rotation of the pressing roller 35, that is, stops the rotation of the fixing belt 31.

The controller 19 determines the predetermined period based on the number of printed sheets in the continuous image forming operation until it is determined that the sheet conveyance failure occurs (until the normal passage of the sheet S is not detected). Specifically, the larger the number of printed sheets, the longer the predetermined period. As an example, when the number of printed sheets is 1 to 5, it is set to be 0 second, when the number of printed sheets is 6 to 29, it is set to be 5 seconds, when the number of printed sheets is 30 to 49, it is set to be 10 seconds, and when the number of printed sheets is 50 or more, it is set to be 20 seconds. The controller 19 may display the occurrence of the sheet conveyance failure, such as the sheet jamming, on the operation panel 71 within the predetermined period. Alternatively, the controller 19 may display it on the operation panel 71 after the predetermined period (after the rotation of the fixing belt 31 is stopped).

On the other hand, in a case where a conveyance failure, such as the sheet jamming, is detected by the fixing sensor 23, the controller 19 stops the driving of the halogen heater 33 and also stops the rotation of the pressing roller 35, that is, stops the rotation of the fixing belt 31. Also, in this case, the controller 19 may display the occurrence of the sheet conveyance failure, such as the sheet jamming, on the operation panel 71.

Additionally, in a case where the sheet conveyance failure, such as the sheet jamming, is detected by the sheet feeding sensor 21 or the fixing sensor 23, the controller 19 drives the fan 39 to cool the fixing belt 31 and the pressing roller 35. Alternatively, in a case where a cover (not shown) of the image forming apparatus 1 is opened in order to treat the sheet jamming, the controller 19 drives the fan 39.

As described above, according to the fixing device 9 of the present disclosure, in a case where a sheet conveyance failure such as the sheet jamming occurs at portions other than the fixing device 9, the pressing roller 35 is kept rotating, that is, the fixing belt 31 is kept rotating for the predetermined period after the driving of the halogen heater 33 is stopped, so that the fixing belt 31 can be prevented from being overheated partially. Accordingly, it becomes possible to prevent the exhausting of the lubricant and to rotate the fixing belt 31 stably.

On the other hand, in a case where a conveyance failure such as the sheet jamming occurs at the fixing device 9, the driving of the halogen heater 33 is stopped and the rotation of the pressing roller 35, that is, the rotation of the fixing belt 31 is stopped as soon as possible, so that it becomes possible to prevent the sheet jamming, for example, to prevent the sheet from being folded in a bellows shape in the fixing device 9 or from being caught by a separation member without being separated properly.

Furthermore, in a case where the number of printed sheets is large, because the heat amount accumulated in the halogen heater 33 is increased, a period until a temperature of the halogen heater 33 is decreased sufficiently becomes long. Then, in a case where the sheet jamming occurs at the portion other than the fixing device 9, the larger the number of printed sheets in the continuous printing operation, the longer the rotation time of the fixing belt 31, so that the heat amount transferred to the fixing belt 31 is distributed to prevent the fixing belt 31 from being overheated partially. In the present embodiment, the predetermined period is set based on the number of printed sheets per one JOB. However, it may be set based on a number of printed sheets within a certain period (for example, 10 minutes) before the sheet jamming is detected. Alternatively, regardless of the number of the JOB and the number of printed sheets, it may be a constant period. Alternatively, it may be set based on a time period during the fixing belt 31 or the halogen heater 33 is heated to a predetermined temperature or higher within a certain period before the conveyance failure is detected.

The heating source which heats the fixing belt 31 is not limited to the halogen heater 33. The second sensor disposed on an upstream side of the fixing device 9 is not limited to the sheet feeding sensor 21, and may be a sensor which detects a sheet jamming occurred in the image forming part 7 or the others. However, the second sensor is preferably disposed in a portion where the sheet jamming easily occurs, so it is preferably disposed between the sheet feeding device 5 and the resist rollers pair 17, where the sheet jamming easily occurs. Additionally, the fixing type of the fixing device 9 is not limited to the present embodiment. However, in a case where the fixing belt 31 is slid with respect to the pushing member 37, like the present embodiment, it becomes possible to prevent the lubricant from being exhausted and to enhance an effect for rotating the fixing belt 31 stably. In a case where the fixing belt 31 and the lubricant are not used, it becomes possible to prevent the fixing member from being overheated partially and from being deteriorated.

While the present disclosure has been described with respect to specific embodiments, the present disclosure is not limited to the embodiments described above. Those skilled in the art can modify the above embodiments without departing from the scope and spirit of the present disclosure.

The invention claimed is:

1. An image forming apparatus comprising:

a sheet feeding device performing a sheet feeding operation for feeding a sheet in a predetermined conveyance direction;

an image forming part disposed on a downstream side of the sheet feeding device in the conveyance direction and forming a toner image on the sheet fed by the sheet feeding device;

a fixing device disposed on a downstream side of the image forming part in the conveyance direction, and including a fixing member heated by a heating source and a pressing member coming into contact with the fixing member to form a pressing area between the fixing member and the pressing member, the fixing member and the pressing member being rotated to fix the image on the sheet as the sheet is passed through the pressing area after passing through the image forming part;

a conveyance path along which the sheet is conveyed from the sheet feeding device to the fixing device through the image forming part;

a first sensor disposed on the conveyance path on a downstream side of the fixing device in the conveyance direction and detecting the sheet passed along the conveyance path; and a second sensor disposed on the conveyance path on an upstream side of the fixing device in the conveyance direction and detecting the sheet passed along the conveyance path; wherein the fixing device stops a driving of the heating source and stops a rotation of the fixing member when the first sensor does not detect the sheet passing properly, and the fixing device stops the driving of the heating source and stops the rotation of the fixing member after a predetermined period when the second sensor does not detect the sheet passing properly, the predetermined period is set to be longer as a number of printed sheets in a continuous printing operation until the second sensor does not detect the sheet passing properly increases.

2. The image forming apparatus according to claim 1, comprising an informing part informing that a sheet conveyance failure occurs, wherein when the second sensor does not detect the sheet passing properly, after the predetermined period, the informing part informs that the sheet conveyance failure occurs.

3. The image forming apparatus according to claim 1, wherein the fixing member is an endless fixing belt, the heating source is a halogen heater disposed in a hollow space of the fixing member, the fixing device further includes a pushing member pushing the fixing member to the pressing member with lubricant from an inner circumferential side of the fixing member at the pressing area, and the fixing member is driven by a rotation of the pressing member to be rotated.

4. The image forming apparatus according to claim 1, further comprising a resist rollers pair disposed on the conveyance path between the sheet feeding device and the image forming part, wherein the second sensor is disposed on the conveyance path between the sheet feeding device and the resist rollers pair.

5. The image forming apparatus according to claim 4, wherein the second sensor is a photo sensor which sends an ON signal when detecting the sheet and sends an OFF signal when detecting a separation of the sheet, and the fixing device stops the driving of the heating source and stops the rotation of the fixing member after the predetermined period in a case where the second sensor does not send the ON signal after a certain period since the sheet feeding device starts a sheet feeding operation and in a case where the second sensor does not send the OFF signal after a certain period since the resist rollers pair starts to be rotated at a suitable timing after the second sensor sends the ON signal.

6. The image forming apparatus according to claim 1, further comprising a fan cooling the fixing member and the pressing member, wherein the fan cools the fixing member and the pressing member when the first sensor and the second sensor do not detect the sheet passing properly.

* * * * *